US011177608B2

(12) United States Patent
Sone

(10) Patent No.: US 11,177,608 B2
(45) Date of Patent: Nov. 16, 2021

(54) STANDBY CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventor: Kosuke Sone, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 27 days.

(21) Appl. No.: 16/628,104

(22) PCT Filed: Jun. 19, 2018

(86) PCT No.: PCT/JP2018/023202
§ 371 (c)(1),
(2) Date: Jan. 2, 2020

(87) PCT Pub. No.: WO2019/009055
PCT Pub. Date: Jan. 10, 2019

(65) Prior Publication Data

US 2021/0159631 A1 May 27, 2021

(30) Foreign Application Priority Data

Jul. 5, 2017 (JP) ..... JP2017-131975

(51) Int. Cl.
*H01R 13/516* (2006.01)
*H01F 7/06* (2006.01)
(Continued)

(52) U.S. Cl.
CPC ..... *H01R 13/516* (2013.01); *H01F 7/06* (2013.01); *H01R 13/506* (2013.01); *H01R 13/73* (2013.01);
(Continued)

(58) Field of Classification Search
CPC ..... H01R 13/516; H01R 13/506; H01R 13/73
(Continued)

(56) References Cited

U.S. PATENT DOCUMENTS 7,179,130 B2 * 2/2007 Judge ..... H01R 27/02 439/188
7,611,374 B1 * 11/2009 Chiu ..... H01R 4/2454 439/402
(Continued)

FOREIGN PATENT DOCUMENTS

JP 2005-190720 7/2005
JP 2015035386 2/2015
(Continued)

OTHER PUBLICATIONS

International Search Report dated Sep. 4, 2018.

*Primary Examiner* — Alexander Gilman
(74) *Attorney, Agent, or Firm* — Gerald E. Hespos; Michael J. Porco; Matthew T. Hespos

(57) ABSTRACT

A standby connector 13 connectable to a device-side connector 10 mounted on a solenoid 12 includes a connector housing 22 connectable to the device-side connector 10 along a connecting direction, and a holder 33 for holding the connector housing 22. The holder 33 includes a pair of resilient deforming portions 35 located on both lateral sides of the connector housing 22 with respect to an intersecting direction intersecting the connecting direction and resiliently deformable in the intersecting direction. The pair of resilient deforming portions 35 come into contact with the connector housing 22 to be resiliently deformed when a force in the intersecting direction is applied to the connector housing 22.

8 Claims, 21 Drawing Sheets

(51) Int. Cl.
*H01R 13/506* (2006.01)
*H01R 13/73* (2006.01)
*H01R 13/627* (2006.01)

(52) U.S. Cl.
CPC .... *H01F 2007/062* (2013.01); *H01R 13/6272* (2013.01); *H01R 2201/26* (2013.01)

(58) Field of Classification Search
USPC ..... 439/527
See application file for complete search history.

(56) References Cited

U.S. PATENT DOCUMENTS 8,481,868 B2 * 7/2013 Dennes ..... H01R 4/2433 174/549
9,153,907 B2 * 10/2015 Yu ..... H01R 13/6278
10,218,120 B2 * 2/2019 Sone ..... H01R 13/518
2005/0282426 A1 * 12/2005 Nagashima ..... H01R 33/7664 439/374
2016/0149333 A1 * 5/2016 Yoshigi ..... H01R 13/516 439/660
2016/0181775 A1 * 6/2016 Kitamura ..... H01R 9/2416 174/72 A
2016/0197435 A1 * 7/2016 Kitamura ..... H01R 13/5829 439/374
2016/0197438 A1 * 7/2016 Kitamura ..... H01R 13/64 439/376
2016/0197460 A1 * 7/2016 Kitamura ..... H01R 13/64 174/72 A
2016/0197461 A1 * 7/2016 Kitamura ..... H01R 24/20 174/72 A
2016/0344137 A1 * 11/2016 Sone ..... H01R 13/6315
2017/0229815 A1 * 8/2017 Sone ..... H01R 13/64

FOREIGN PATENT DOCUMENTS

JP 2015-103315 6/2015
JP 2015-153661 8/2015
JP 2016-081727 5/2016
JP 2016-100224 5/2016
WO 2017/082228 5/2017

* cited by examiner

STANDBY CONNECTOR

BACKGROUND

Field of the Invention

This specification relates to a standby connector.

Related Art

Japanese Unexamined Patent Publication No. 2005-190720 discloses a standby connector that includes a plug housing that is fittable to a mating receptacle housing. The plug housing includes resilient engaging portions that engage an edge of a hole in a panel bulkhead when the plug housing is inserted in the hole in the panel bulkhead. The plug housing is movable in orthogonal to the fitting direction by resilient deformation of each resilient engaging portion. As a result, the receptacle housing and the plug housing can be fit together even if there is a positional deviation between the receptacle housing and the plug housing due to fitting tolerances.

However, there is a problem in that the above-described standby connector cannot be applied unless a structure equivalent to the hole of the panel bulkhead is present.

This specification was completed on the basis of the above situation and provides a standby connector that is connectable to a device-side connector by a simple configuration even if there is a positional deviation.

SUMMARY

This specification is directed to a standby connector connectable to a device-side connector mounted on a device. The standby connector includes a connector housing connectable to the device-side connector along a connecting direction, and a holder for holding the connector housing. The holder includes two resilient deforming portions that are located on both lateral sides of the connector housing with respect to an intersecting direction intersecting the connecting direction and that are resiliently deformable in the intersecting direction. At least one of the resilient deforming portions contacts the connector housing and resiliently deforms when a force in the intersecting direction is applied to the connector housing.

The standby connector contacts the device side connector if there is a positional deviation between the standby connector and the device-side connector in the intersecting direction, and this contact causes the standby connector to receive a force in the intersecting direction. Accordingly even if there is a positional deviation between the standby connector and the device-side connector in the intersecting direction, the resilient deforming portions resiliently deform in the intersecting direction to absorb the positional deviation. Thus, the standby connector and the device-side connector can be connected smoothly.

The connector housing may be assembled with the holder in a direction intersecting the connecting direction and different from the intersecting direction. The resilient deforming portions extend along the assembling direction, and each of the resilient deforming portions includes a first locking portion to be locked to the connector housing from behind in the assembling direction. According to this configuration, the connector housing can be assembled with the holder along the assembling direction.

The connector housing may include a wire routing portion at a rear position in the connecting direction, and a wire drawn out from the connector housing may be disposed in the wire routing portion. The wire may be drawn out from the wire routing portion in a direction intersecting the connecting direction. Additionally, the holder may include a pressing portion for pressing the wire routing portion forward from behind in the connecting direction. According to this configuration, the wire is not disposed in an area behind the wire routing portion in the connecting direction. Thus, the holder can have the pressing portion for pressing the wire routing portion forward from behind in the connecting direction. As a result, the pressing portion of the holder can be pressed forward in the connecting direction so that the connector housing and the device-side connector can be connected reliably.

The connector housing may be assembled with the holder in a direction intersecting the connecting direction and different from the intersecting direction. Additionally, the resilient deforming portions may extend along the assembling direction. Each of the resilient deforming portions may include a first locking portion to be locked to the connector housing from behind in the assembling direction, and the pressing portion may include a second locking portion to be locked to the wire routing portion from behind in the assembling direction. According to this configuration, the second locking portion prevents the wire routing portion from moving rearward in the assembling direction and separating from the holder.

According to this specification, the standby connector and the device-side connector can be connected smoothly even if there is a positional deviation.

DETAILED DESCRIPTION

An embodiment of the invention that is applied to a hydraulic control device of an automatic transmission of an unillustrated vehicle is described with reference to FIGS. 1 to 21. In the following description, a Z direction is an upward direction, a Y direction is a forward direction and an X direction is a rightward or lateral direction. Further, for a plurality of identical members, only some members may be denoted by reference signs and the other members may not be denoted by the reference signs.

(Device-Side Connector 10)

Figure 1:
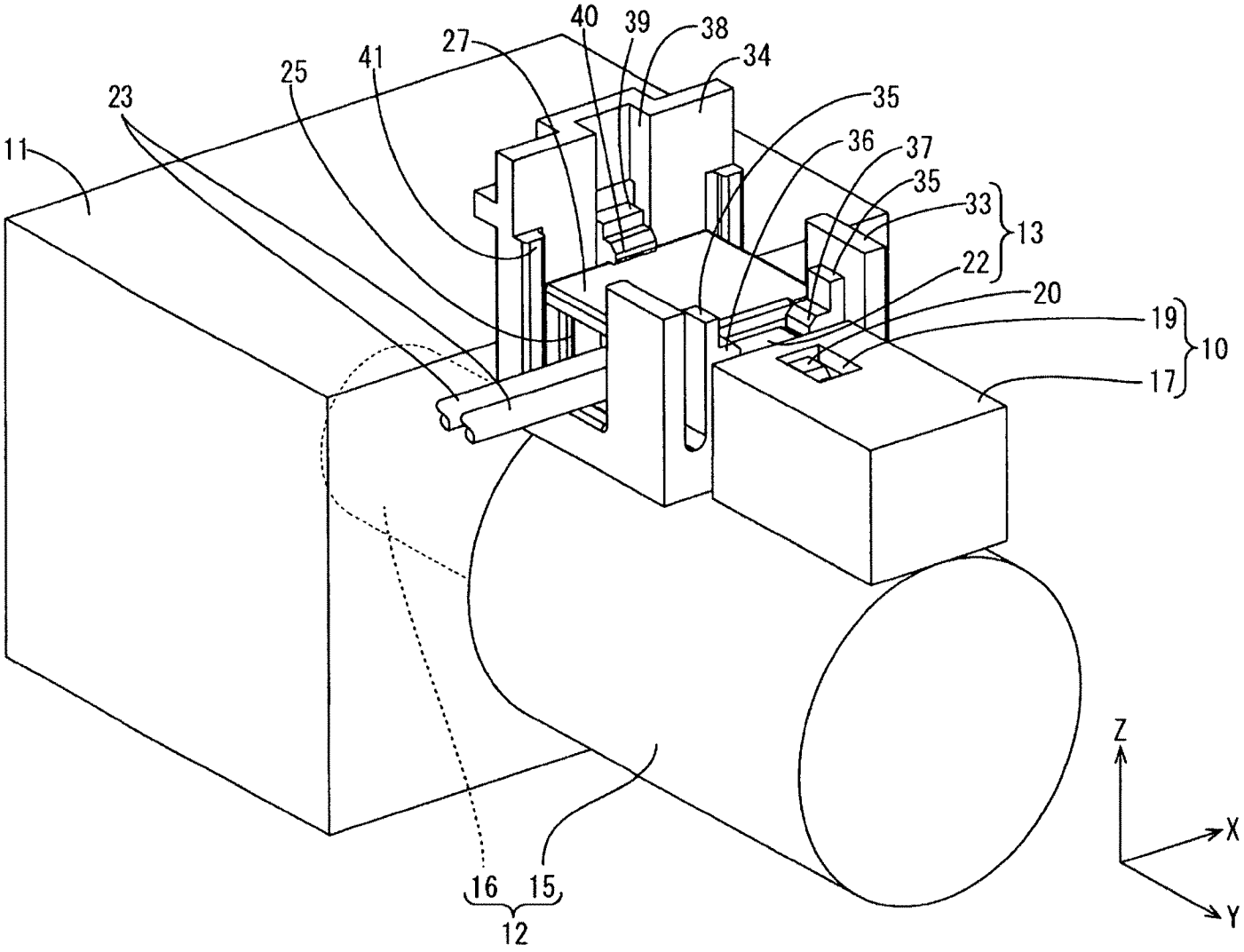
FIG. 1 is a perspective view showing a state where a standby connector according to an embodiment and a device-side connector are connected.
Figure 2:
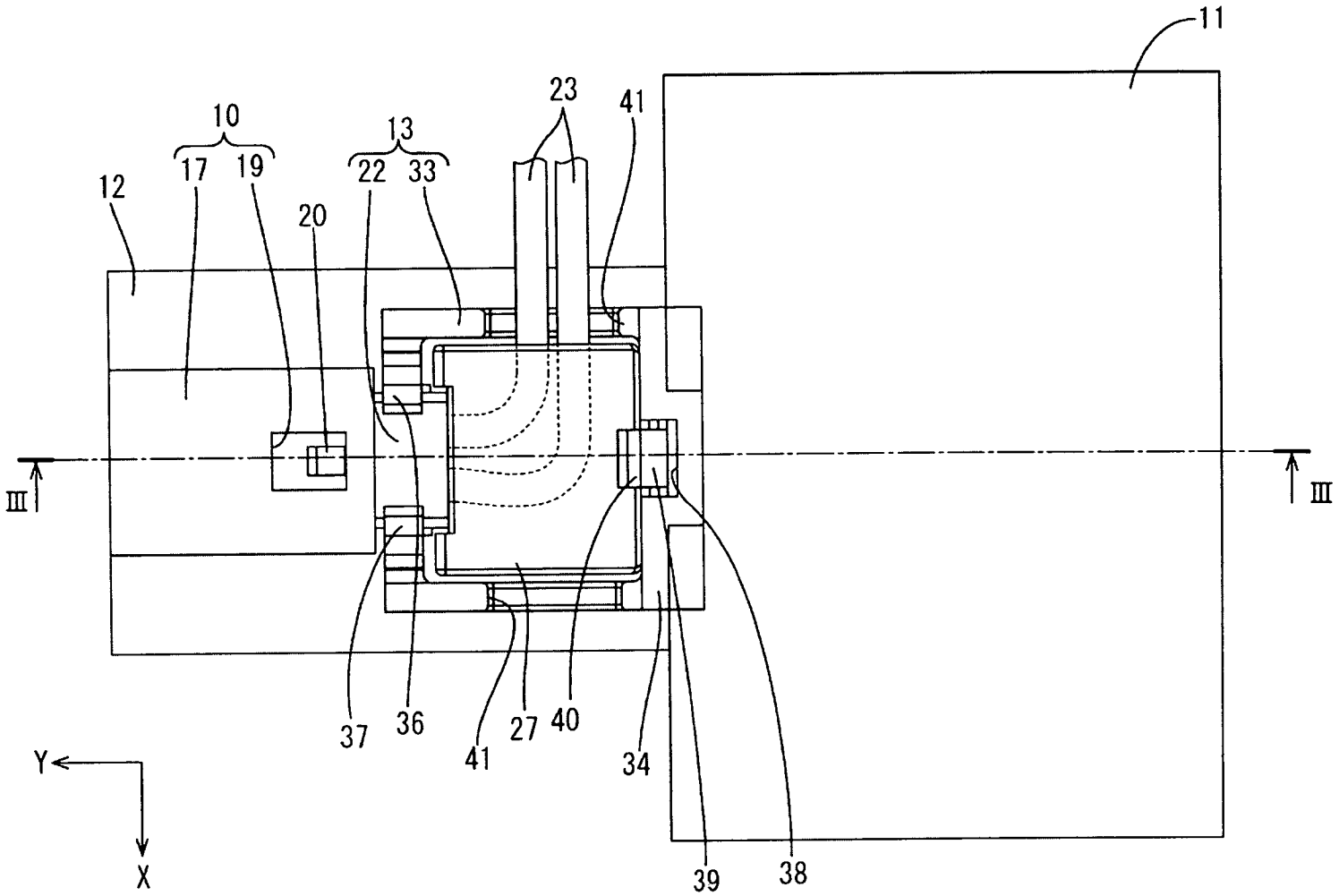
FIG. 2 is a plan view showing the state where the standby connector and the device-side connector are connected.

As shown in FIGS. 1 and 2, the hydraulic control device includes a valve body 11, and solenoids 12 (an example of devices) are incorporated into this valve body 11 (one solenoid 12 is shown in FIG. 1). Standby connectors 13 are provided to correspond to the respective solenoids 12, but one standby connector 13 and one solenoid 12 are shown in FIG. 1. The one standby connector 13 and the one solenoid 12 are described below.

Figure 3:
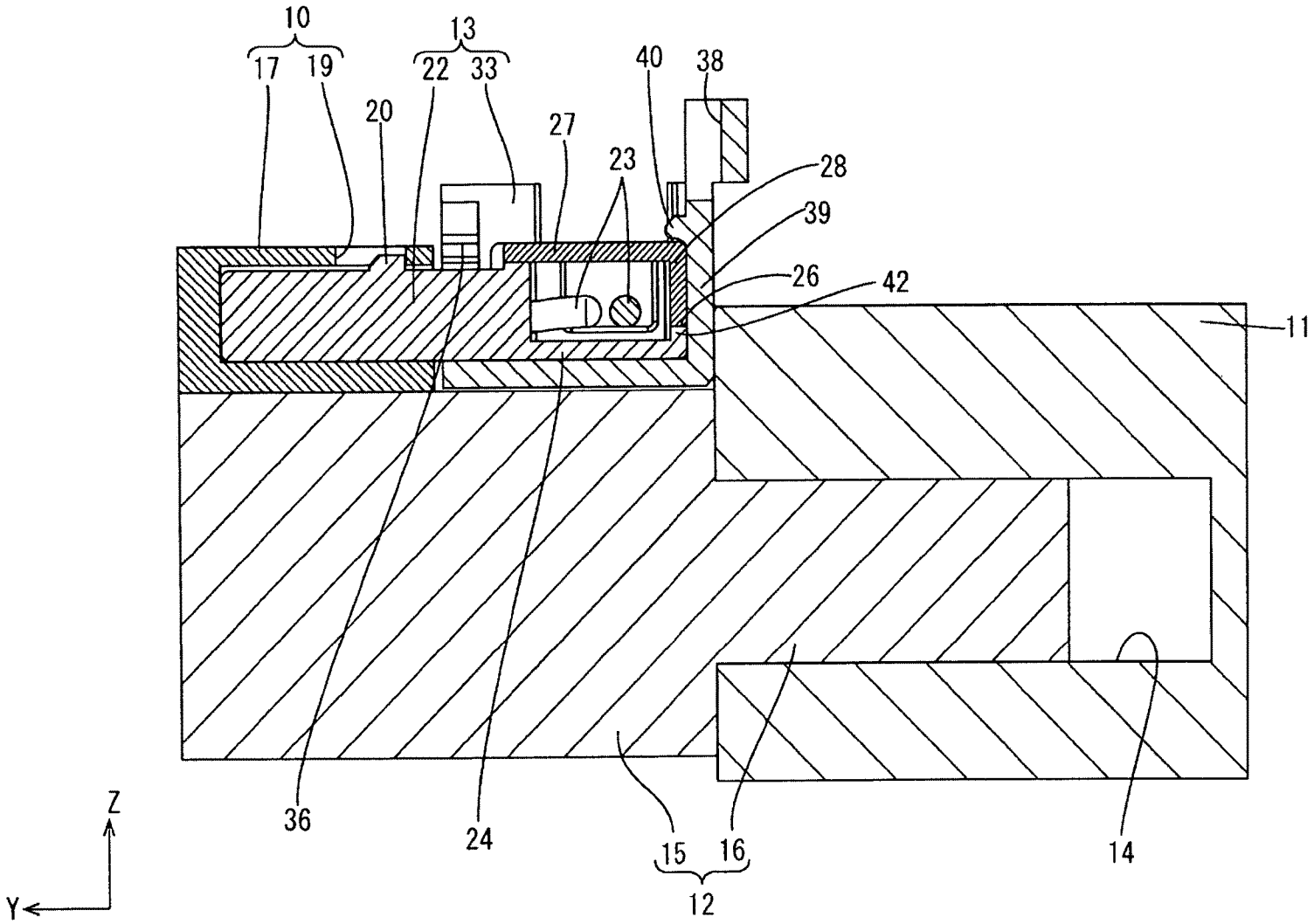
FIG. 3 is a section along in FIG. 2.
Figure 4:
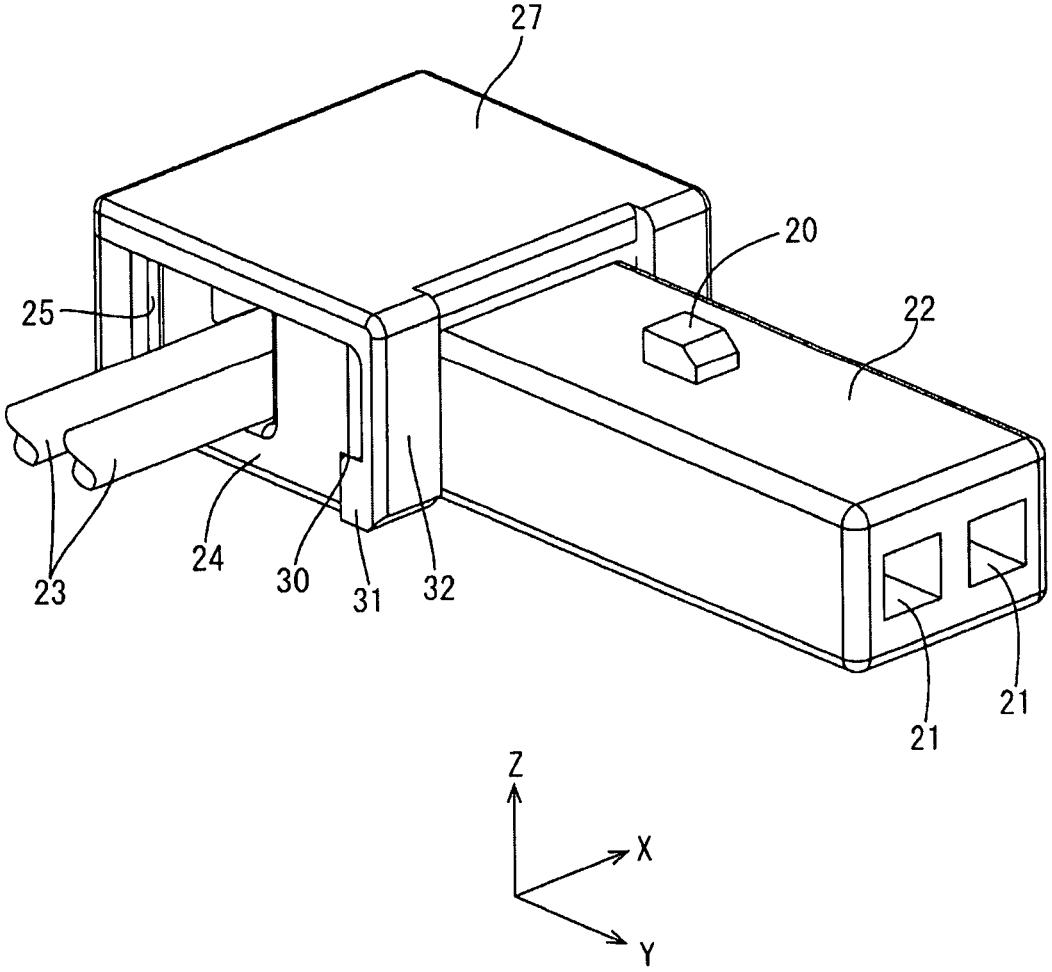
FIG. 4 is a perspective view showing a connector housing in a state where a cover is mounted on a wire routing portion.

As shown in FIG. 3, a solenoid mounting portion 14 is recessed rearward in the valve body 11, and the solenoid 12 is mounted in the solenoid mounting portion 14. The solenoid 12 is composed of a large-diameter portion 15 having a substantially hollow cylindrical shape and a small-diameter portion 16 having a substantially hollow cylindrical shape with a diameter smaller than the large-diameter portion 15. The large-diameter portion 15 and the small-diameter portion 16 are coaxial and adjacent in a front-rear direction. An outer diameter of the small-diameter portion 16 is equal to or slightly smaller than an inner diameter of the solenoid mounting portion 14. In this way, the small-diameter portion 16 can be inserted into the solenoid mounting portion 14.

A device-side connector 10 projects up on the outer peripheral surface of the large-diameter portion 15, and a receptacle 17 projects from the outer peripheral surface of the large-diameter portion 15. The receptacle 17 is made of insulating synthetic resin and is a substantially rectangular rearwardly-open tube extending parallel to the axis of the large-diameter portion 15. Male terminals (not shown) project rearward in the receptacle 17. Front end parts of the male terminals are bent radially inward of the large-diameter portion 15 inside a front wall of the receptacle 17 and, although not shown in detail, are connected electrically to the solenoid 12. A lock hole 19 is open in the upper surface of the receptacle 17, and a lock protrusion 20 of the standby connector 13 is lockable to the lock hole 19 when the standby connector 13 to be described later and the device-side connector 10 are connected properly. In this embodiment, the device-side connector 10 is connected to the standby connector 13 from the front, whereas the standby connector 13 is connected to the device-side connector 10 from behind. Specifically, the front-rear direction is a connecting direction in this embodiment.

(Standby Connector 13)

Figure 12:
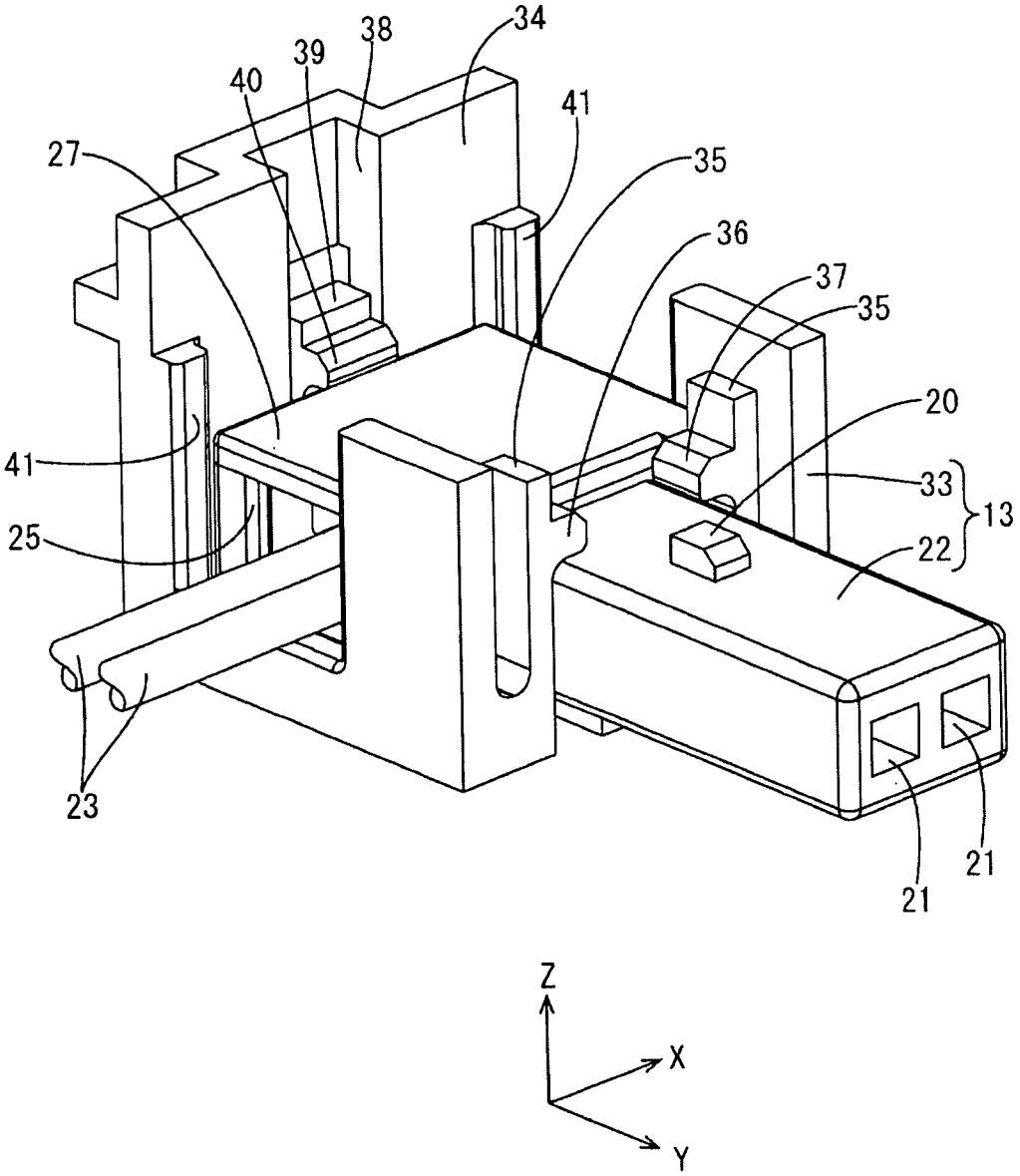
FIG. 12 is a perspective view showing the standby connector.

As shown in FIG. 12, the standby connector 13 includes a connector housing 22 made of an insulating synthetic resin and a holder 33 for holding the connector housing 22. Cavities 21 (two in this embodiment) are formed in the connector housing 22 for accommodating female terminals (not shown). Each cavity 21 extends in the front-rear direction and is open in front and rear of the connector housing 22. The two cavities 21 are formed side by side in a lateral direction. The lock protrusion 20 projects up on an upper wall of the connector housing 22.

Figure 5:
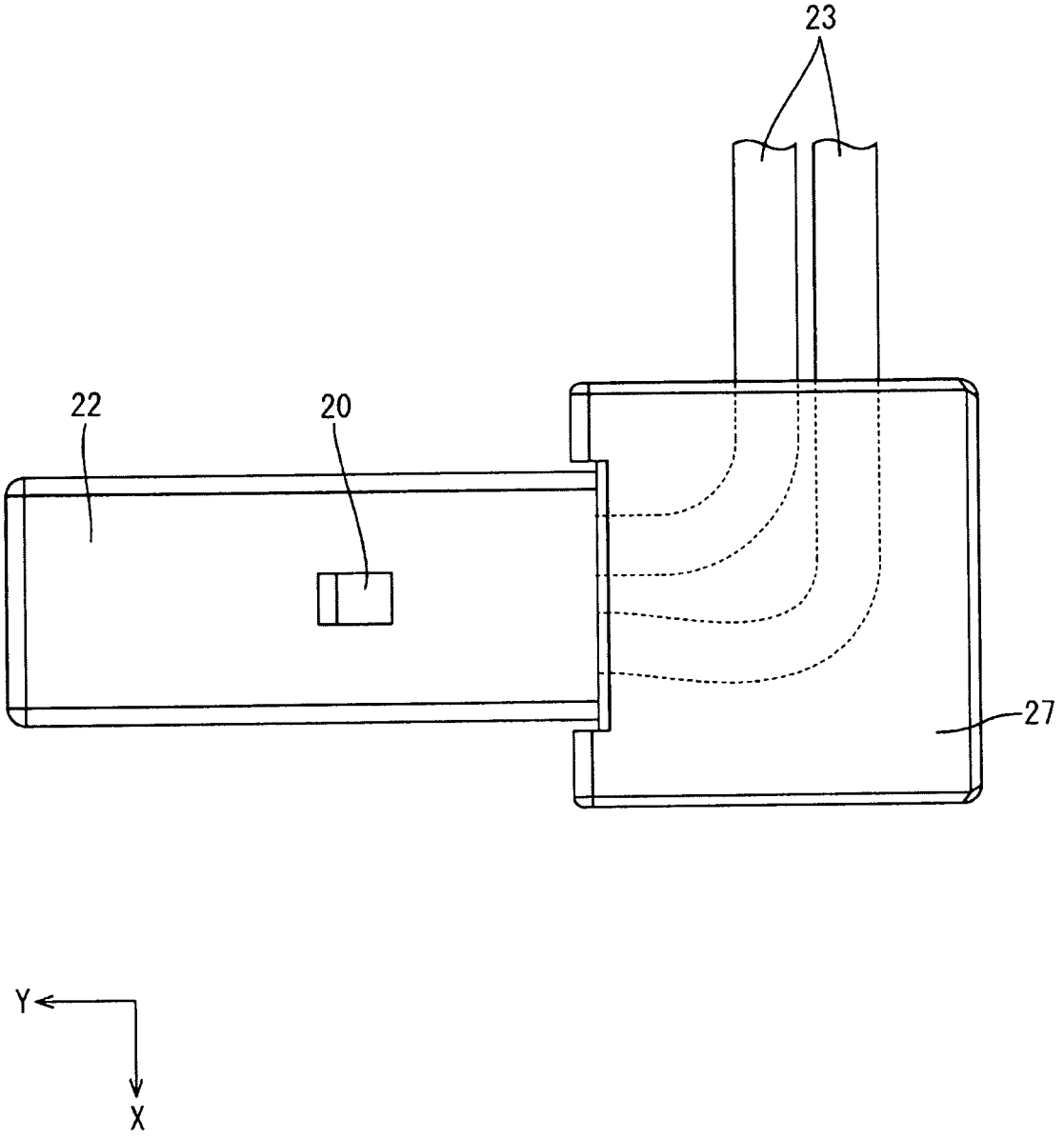
FIG. 5 is a plan view showing the connector housing in the state where the cover is mounted on the wire routing portion.
Figure 6:
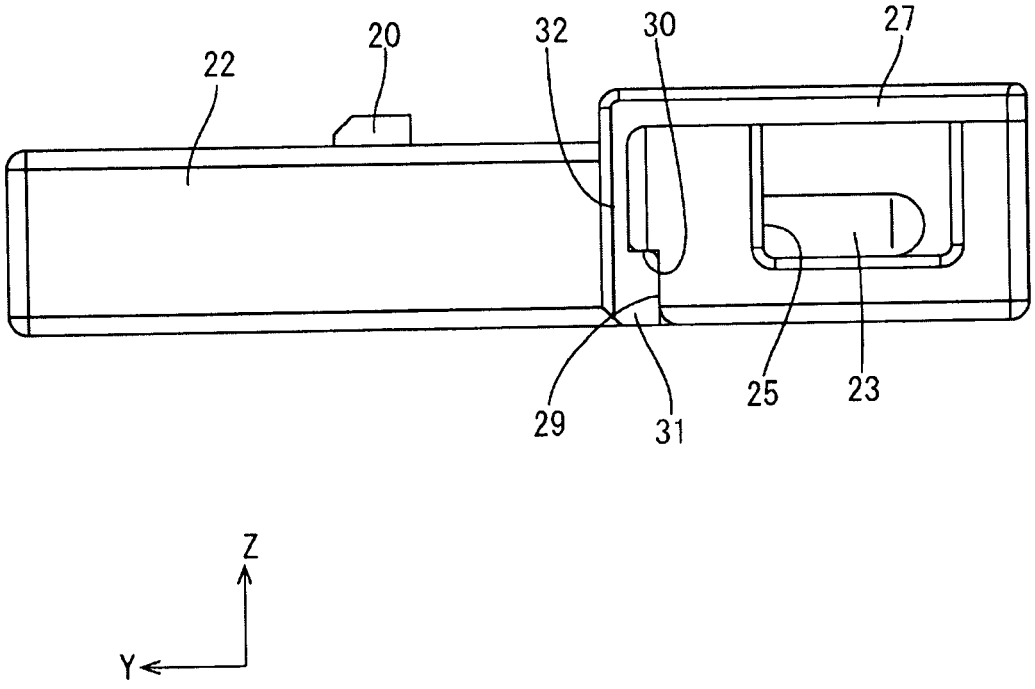
FIG. 6 is a right side view showing the connector housing in the state where the cover is mounted on the wire routing portion.
Figure 7:
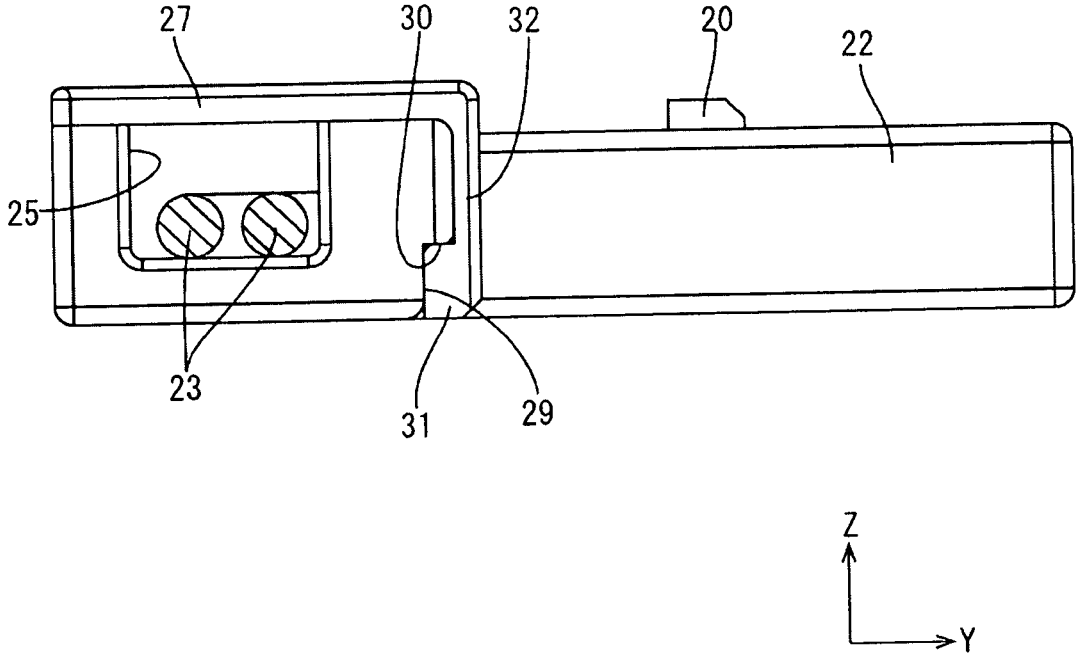
FIG. 7 is a left side view showing the connector housing in the state where the cover is mounted on the wire routing portion.
Figure 8:
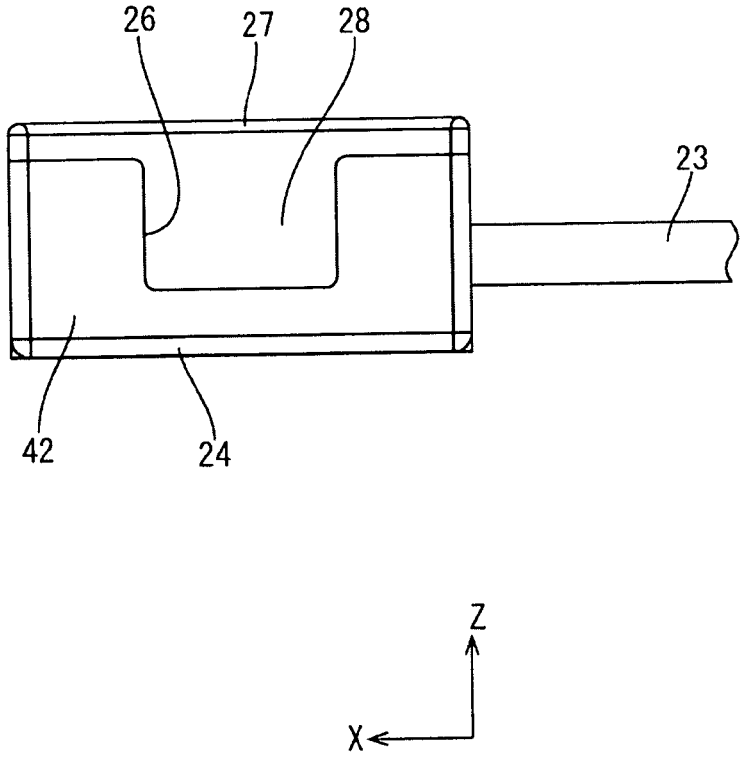
FIG. 8 is a back view showing the connector housing in the state where the cover is mounted on the wire routing portion.

As shown in FIG. 5, wires 23 connected to the respective female terminals are drawn out rearward from a rear end of the connector housing 22. A wire routing portion 24 projects rearward from a bottom wall at the rear of the connector housing 22, and the wires 23 drawn out from the connector housing 22 are routed on this wire routing portion 24. As shown in FIGS. 4 to 8, the wire routing portion 24 includes a bottom wall, a rear wall 42 rising up from a rear part of the bottom wall, a left side wall rising up from a left side of the bottom wall, a right side wall rising up from a right side of the bottom wall and a front wall rising up from a front end of the bottom wall.

The left and right side walls are formed with windows 25 through which the wires 23 are introduced into or drawn out from the wire routing portion 24. The wires 23 are drawn out leftward or rightward of the wire routing portion 24 through the windows 25 formed in the left or right side wall of the wire routing portion 24. In this embodiment, the two wires 23 drawn out from the connector housing 22 are drawn out leftward of the wire routing portion 24, and the lateral direction is an example of an intersecting direction intersecting the connecting direction.

The rear wall 42 of the wire routing portion 24 is formed with a recess 26 recessed downward from an upper part of the rear wall 42, and a projection 28 of a cover 27 to be described later is fit into this recess 26.

A part of the front surface of the front wall of the wire routing portion 24 near a lower end part is recessed rearward to provide a locking recess 29. A step 30 is formed between this locking recess 29 and the front surface of the front wall. Locking claws 31 of the cover 27 to be described later contact this step 30 from below to assemble the cover 27 is assembled with the wire routing portion 24.

The wire routing portion 24 is open upward, and the cover 27 is assembled with the wire routing portion 24 from above. By assembling the cover 27 with the wire routing portion 24, an opening of the wire routing portion 24 is closed. The cover 27 includes an upper wall that is the same size as or slightly larger than the bottom wall of the wire routing portion 24, and two arms 32 project down from both left and right sides of the front of the upper wall. The arms 32 are in the form of plates resiliently deformable in the front-rear direction, and the locking claws 31 project rearward on lower end parts of the arms 32.

The projection 28 projects down at a substantially laterally center position on a rear part of the upper wall of the cover 27. This projection 28 has a substantially rectangular shape when viewed from behind and is the same size as or slightly smaller than an opening edge of the recess 26 in the rear wall 42 of the wire routing portion 24. In this way, the projection 28 is fittable into the recess 26. The cover 27 is assembled with the wire routing portion 24 from above and protects the wires 23 routed inside the wire routing portion 24 from external matter.

(Holder 33)

Figure 9:
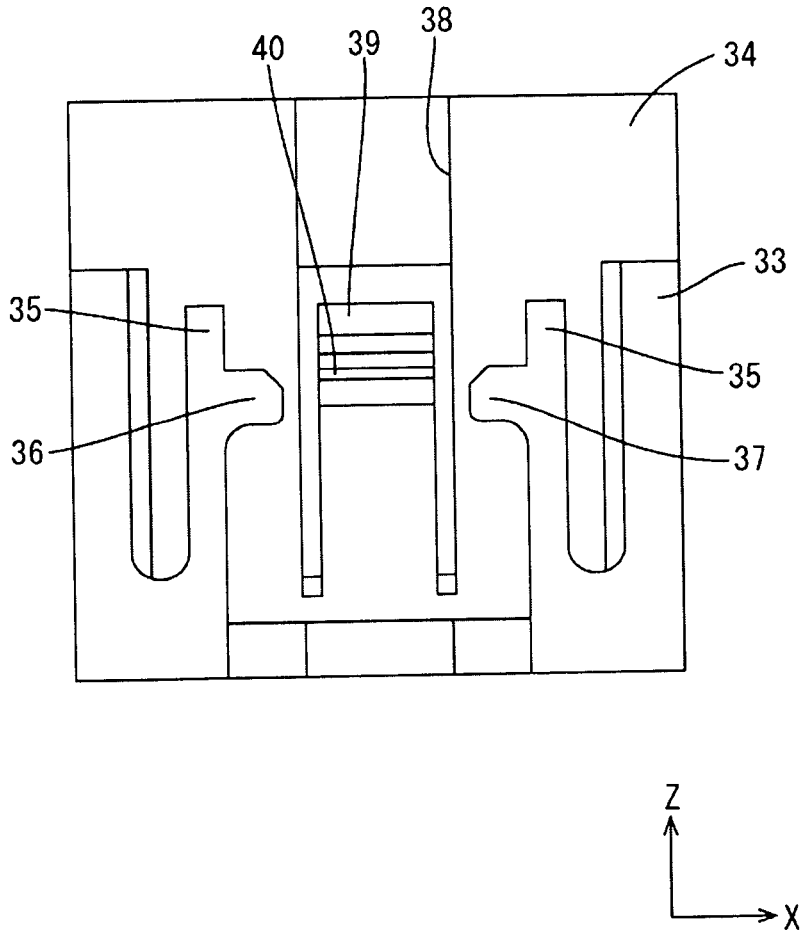
FIG. 9 is a front view showing a holder.
Figure 10:
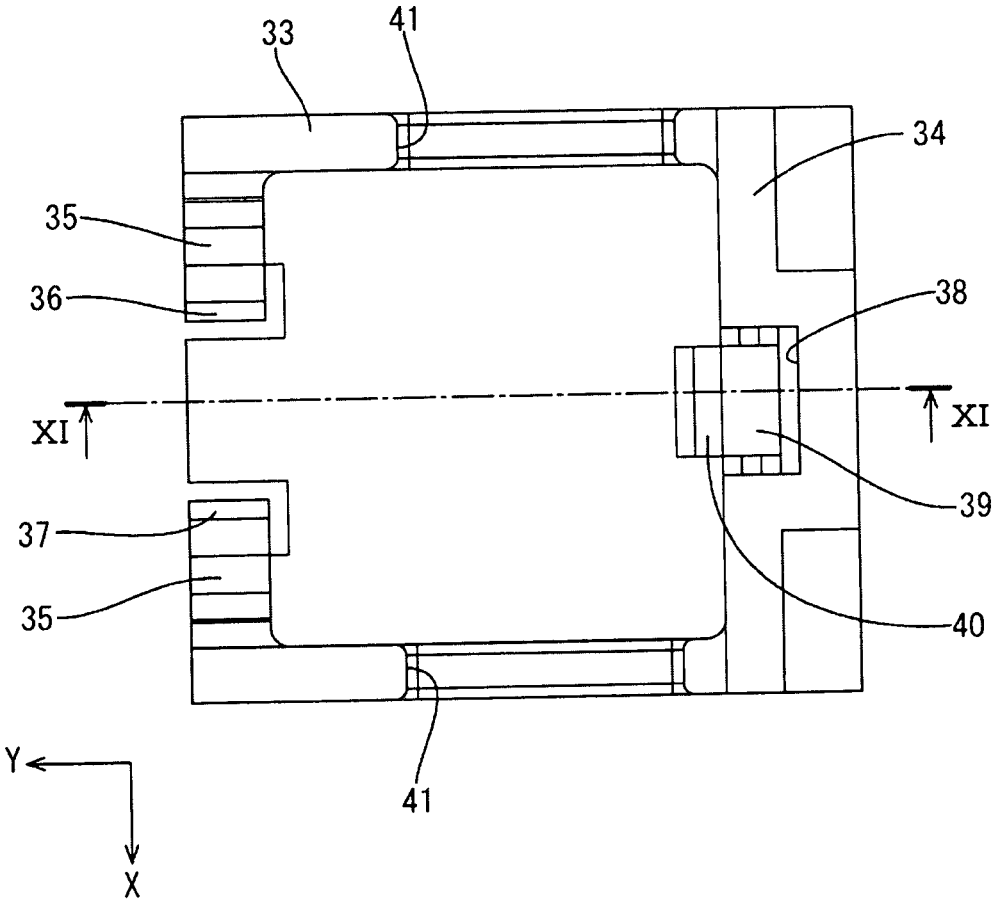
FIG. 10 is a plan view showing the holder.
Figure 11:
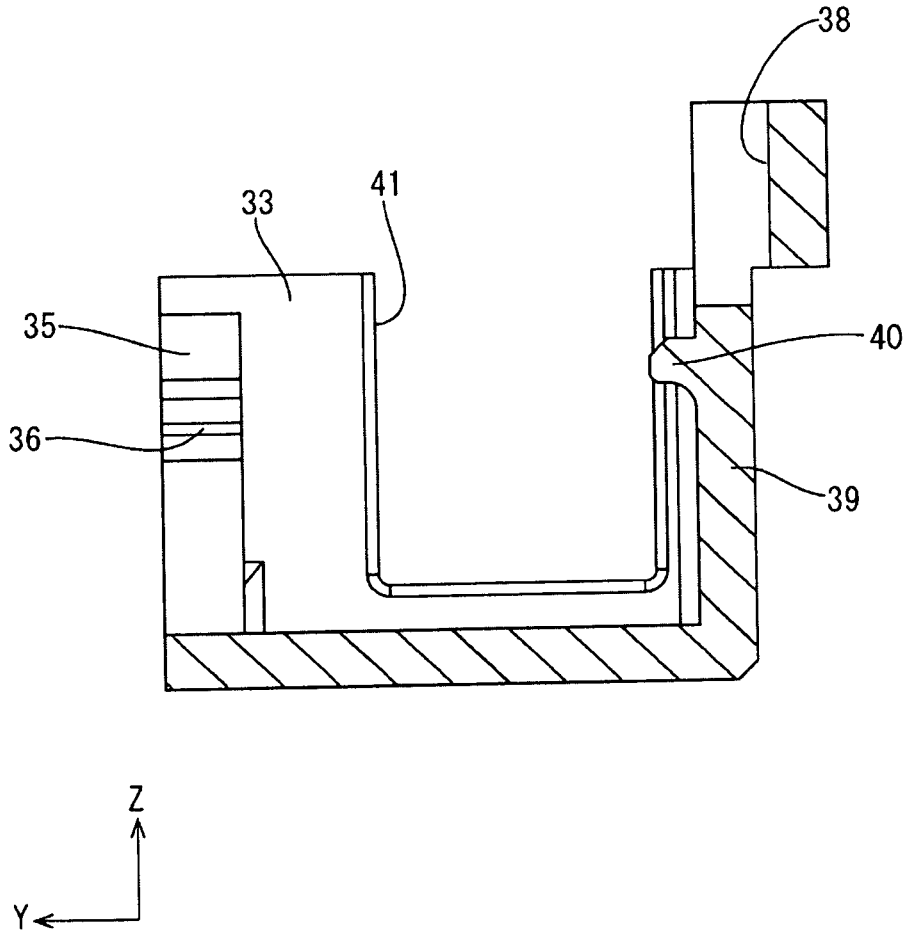
FIG. 11 is a section along XI-XI in FIG. 10.

As shown in FIG. 1, the holder 33 made of synthetic resin and is mounted on a front part of the valve body 11. As shown in FIGS. 9 to 11, the holder 33 includes a bottom wall, a rear wall 34 (an example of a pressing portion) rising up from a rear part of the bottom wall, a left side wall rising up from a left side of the bottom wall, a right side wall rising up from a right side edge of the bottom wall, and two resilient deforming portions 35 rising up from positions near both left and right parts of a front edge of the bottom wall. Thus, the holder 33 is open upward, and the connector housing 22 is assembled with the holder 33 from above (an example of an assembling direction). An interval between the resilient deforming portions 35 is equal to or slightly larger than a lateral width of the connector housing 22.

Figure 13:
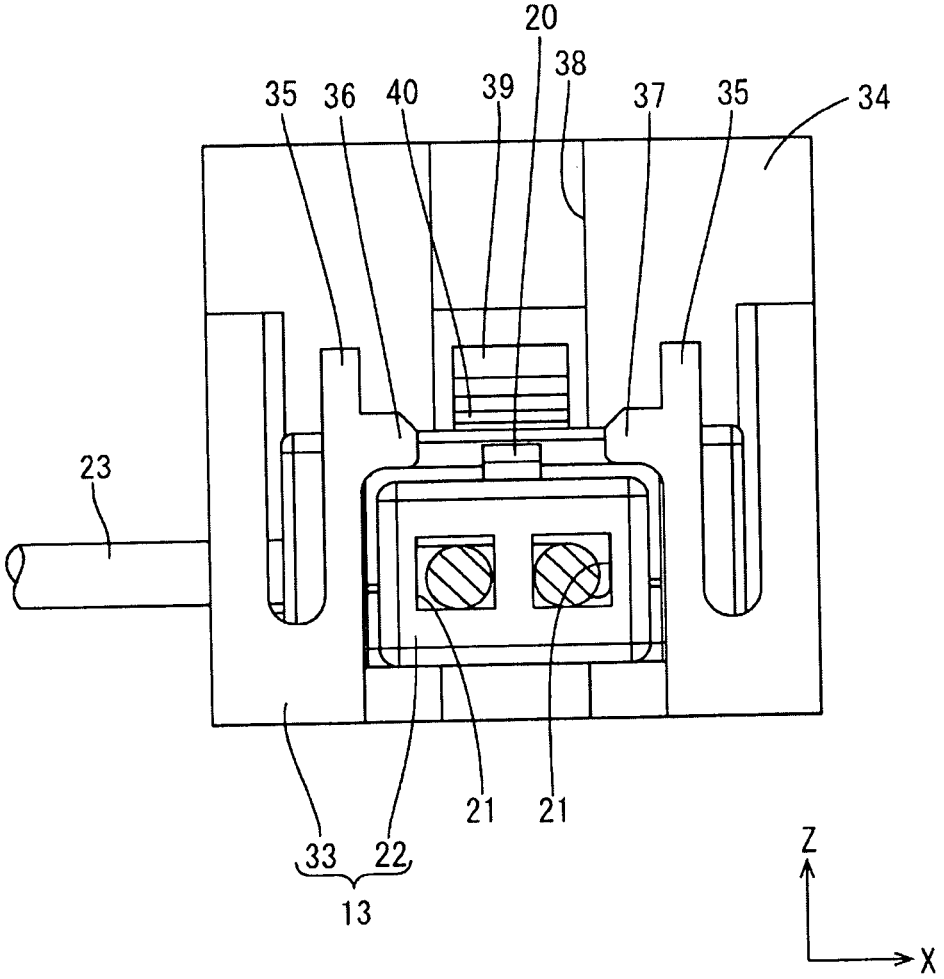
FIG. 13 is a front view showing the standby connector.
Figure 14:
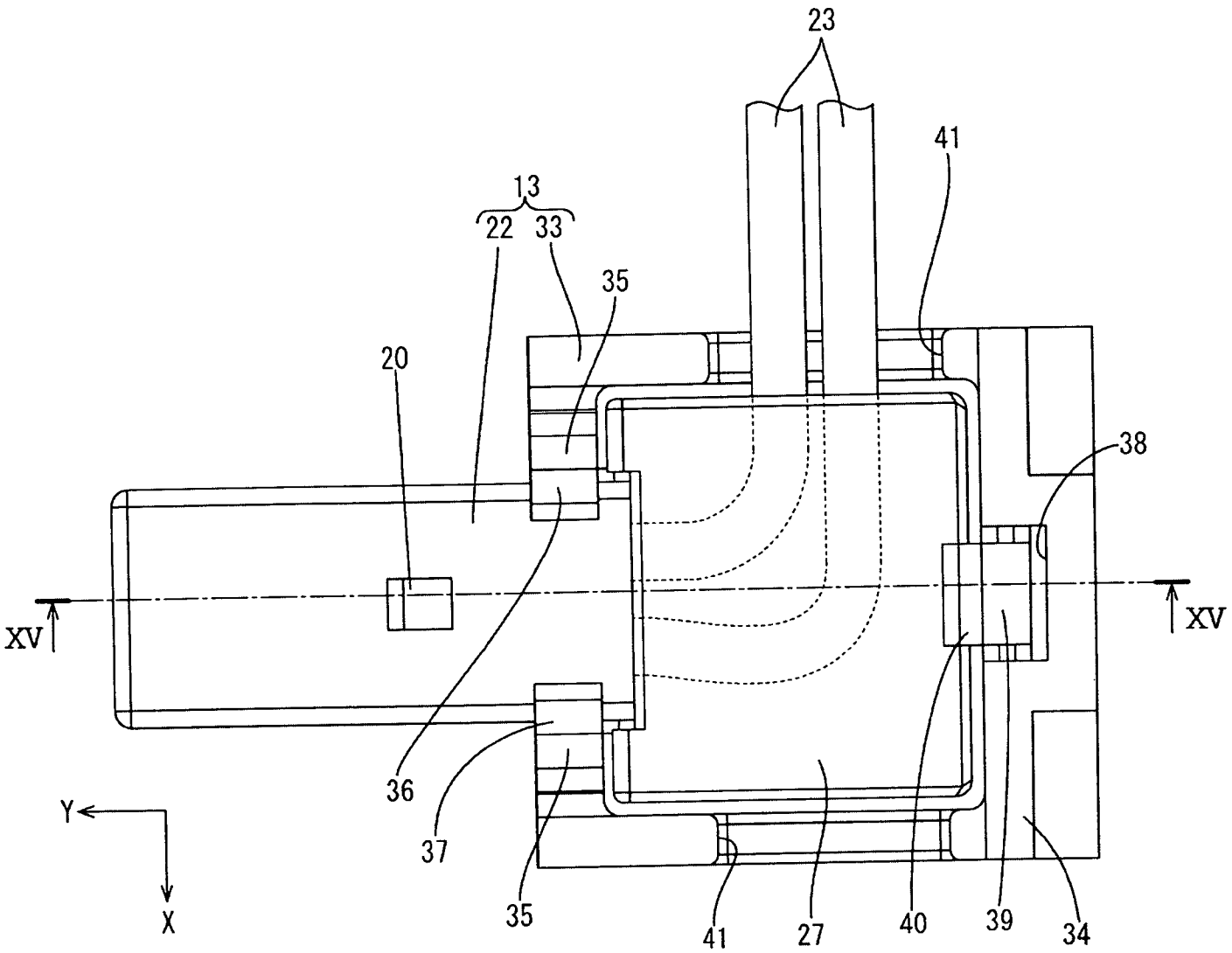
FIG. 14 is a plan view showing the standby connector.

A left first locking portion 36 projects rightward at a position near an upper end of the resilient deforming portion 35 that is provided on a left side of the holder 33, and a right first locking portion 37 projects leftward at a position near an upper end of the resilient deforming portion 35 that is provided on a right side. As shown in FIGS. 12 and 13, the left and right first locking portions 36, 37 contact the connector housing 22 from above to prevent an upward escape of the connector housing 22 from the holder 33.

As shown in FIG. 13, a vertical interval between lower end parts of the left first locking portions 36 and the right first locking portion 37 and the bottom wall is equal to or slightly larger than a vertical height of the upper surface of the connector housing 22 from the bottom wall when the connector housing 22 is placed on the bottom wall.

A vertically extending groove 38 is recessed rearwardly at a substantially lateral center position of the rear wall 34 of the holder 33. An arm 39 extending up from a rear end part of the bottom wall below this recessed groove 38. The arm 39 is resiliently deformable in the front-rear direction, and a second locking portion 40 projects forward on an upper part of the arm 39. The second locking portion 40 contacts the wire routing portion 24 from above to prevent an upward escape of the wire routing portion 24 from the holder 33.

Figure 15:
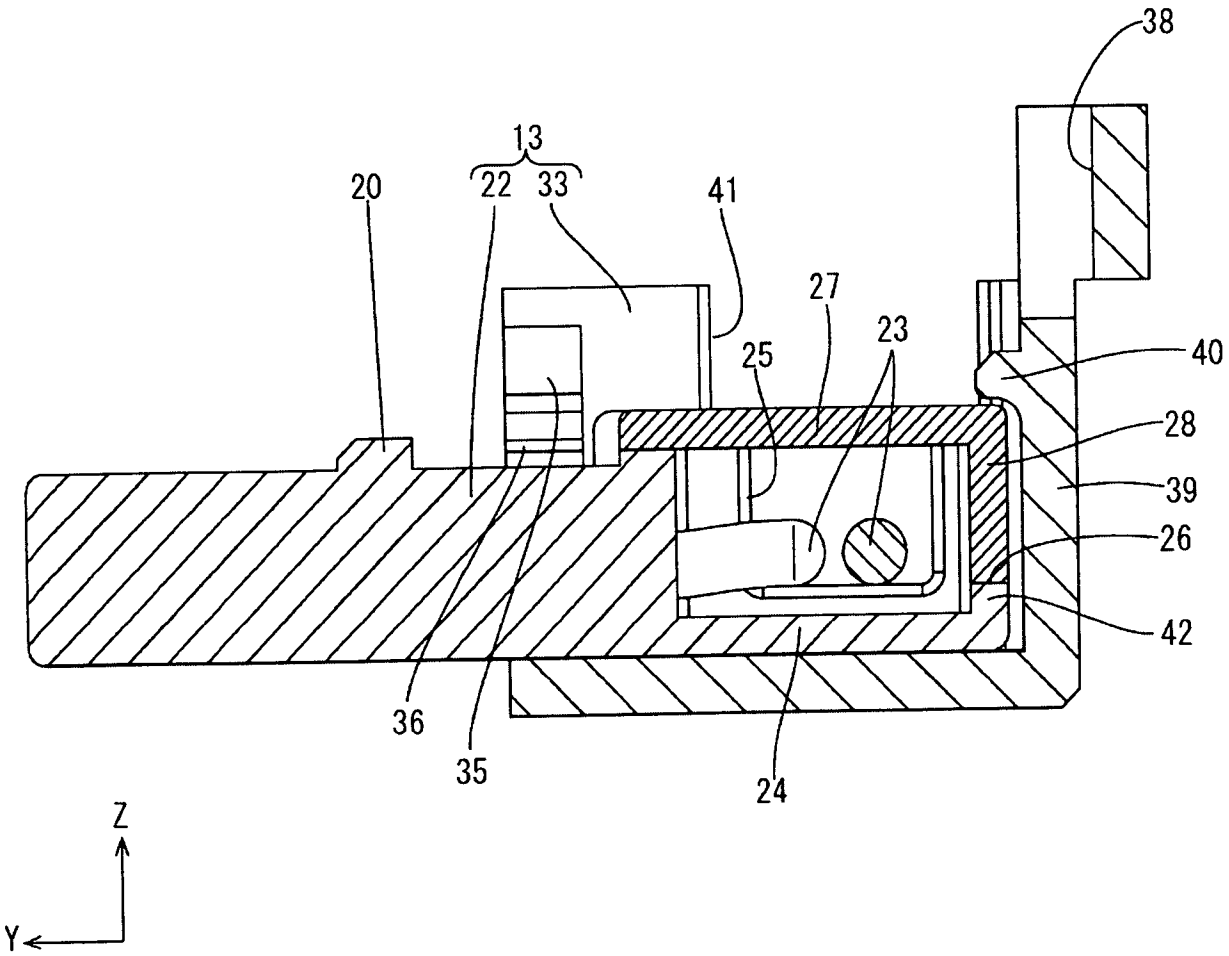
FIG. 15 is a section along XV-XV in FIG. 14.

As shown in FIG. 15, a vertical interval between a lower end part of the second locking portion 40 and the bottom wall is equal to or slightly larger than a vertical height of the upper surface of the upper wall of the cover 27 from the bottom wall with the connector housing 22 placed on the bottom wall.

The left and right walls of the holder 33 are formed respectively with holder-side windows 41. The holder-side windows 41 are larger than the windows 25 in the left and right side walls of the wire routing portion 24. The wires 23 are inserted through the holder-side windows 41.

(Assembling Process of Connector Structure According to Embodiment)

Next, an example of an assembling process of a connector structure according to this embodiment is described. The connector structure assembling process is not limited to the one described below.

First, the female terminals are connected to ends of the wires 23 by a known method such as crimping, welding or soldering. The female terminals connected to the wires 23 are inserted into the cavities 21 of the connector housing 22 from behind. The wires 23 drawn out from the rear end of the connector housing 22 are bent leftward in the wire routing portion 24 and are drawn out leftward (direction intersecting the connecting direction) through the window 25 on the left side of the wire routing portion 24.

Figure 16:
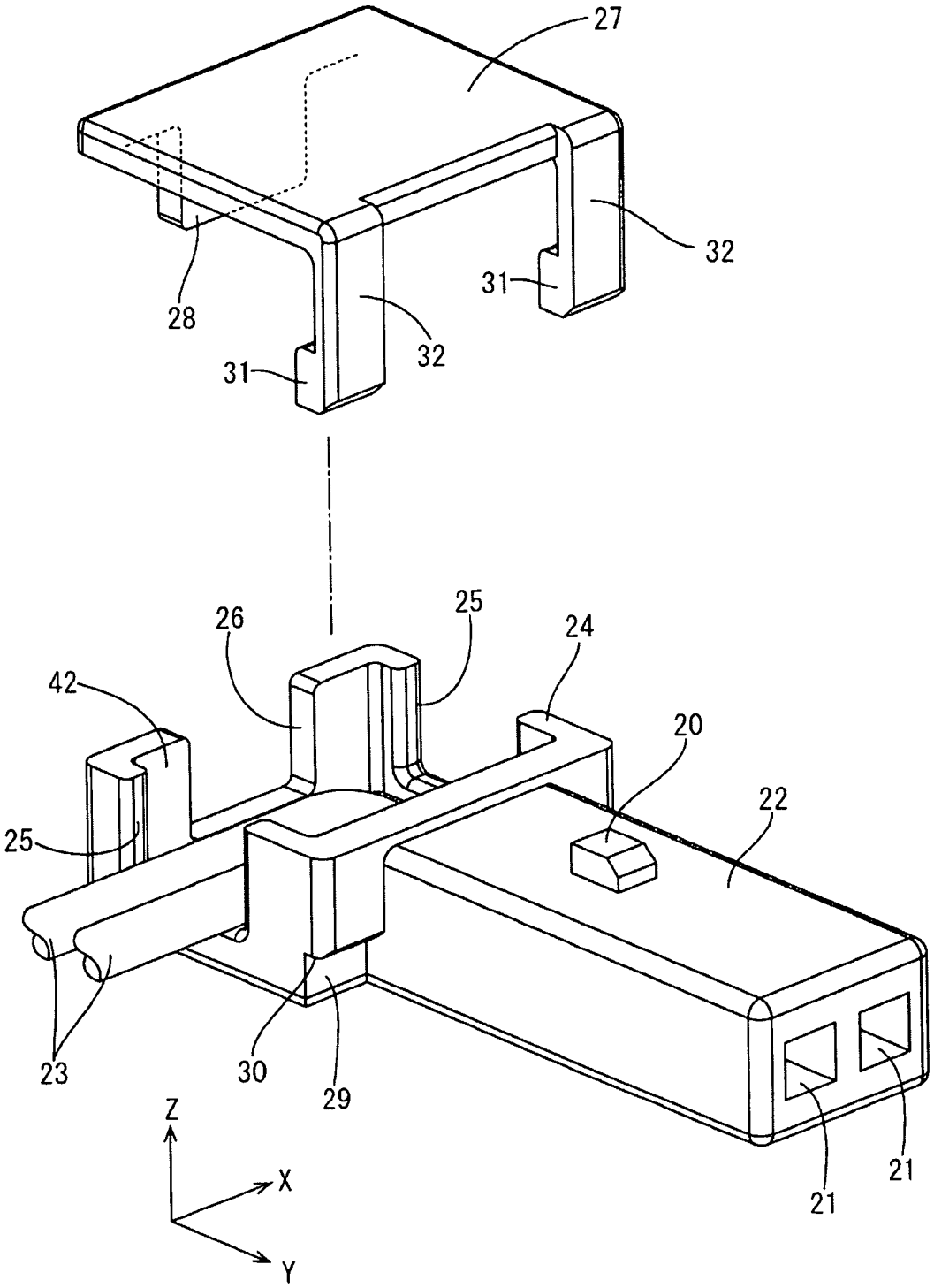
FIG. 16 is an exploded perspective view showing a process of assembling the cover with the wire routing portion of the connector housing.

As shown in FIG. 16, the cover 27 is assembled with the wire routing portion 24 from above so that the locking claws 31 of the arms 32 contact the upper edge of the front wall of the wire routing portion 24. The cover 27 is pressed farther down so that the arms 32 deform resiliently forward and the locking claws 31 ride on the front surface of the front wall of the wire routing portion 24. Further downward pressing of the cover 27 causes the locking claws 31 to enter the locking recess 29 in the front wall of the wire routing portion 24. The arms 32 then restore and the locking claws 31 are accommodated into the locking recess 29. As a result, the locking claws 31 contact the step 30 from below to prevent upward removal of the cover 27. At this time, the projection 28 of the cover 27 is fit into the recess 26 in the rear wall 42 of the wire routing portion 24. Thus, the cover 27 is assembled with the wire routing portion 24 and covers the wires 23 drawn out rearward from the connector housing 22.

Figure 17:
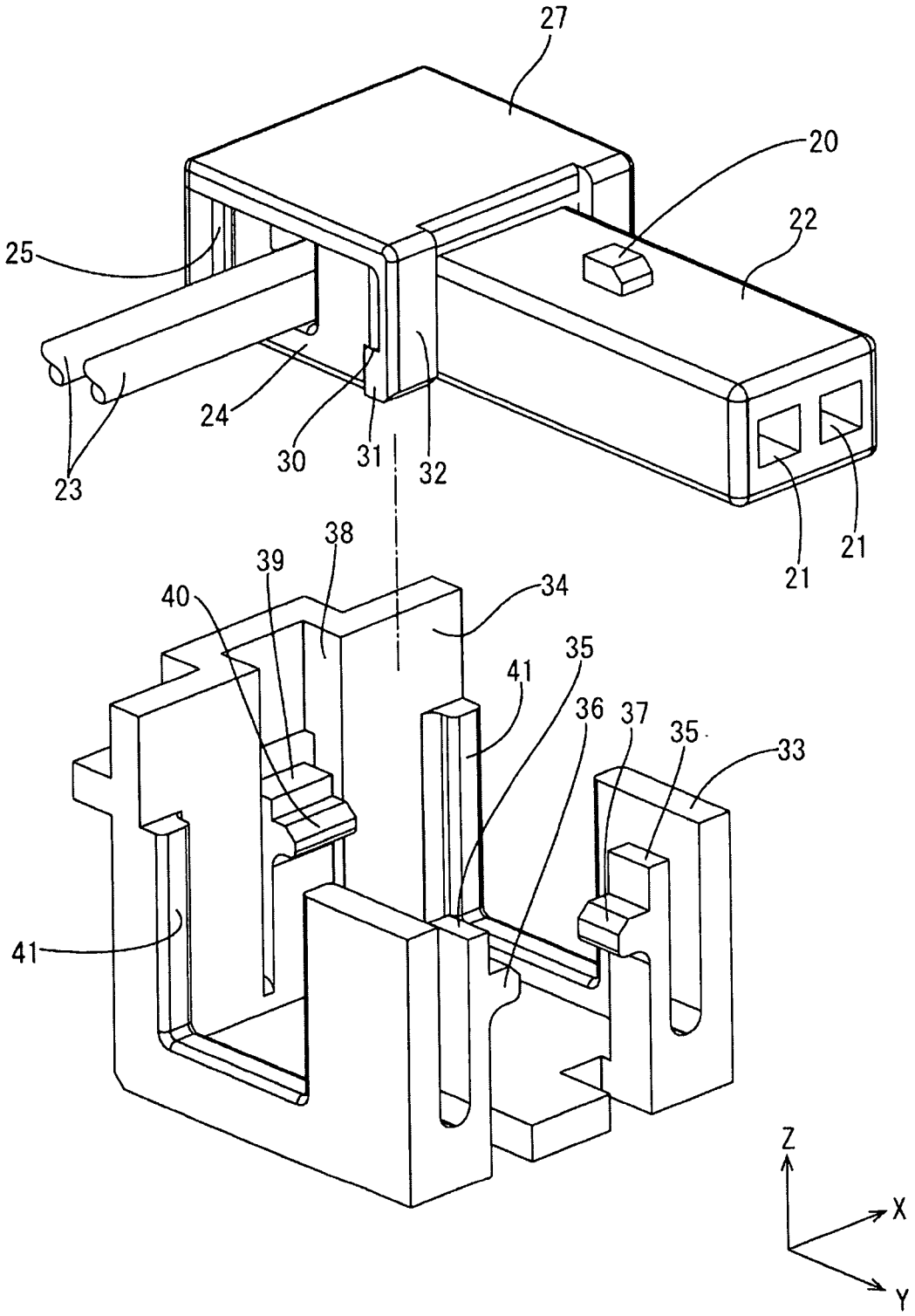
FIG. 17 is an exploded perspective view showing a process of assembling the connector housing with the holder.

Subsequently, as shown in FIG. 17, the connector housing 22 having the cover 27 mounted thereon is assembled with the holder 33 from above. Then, the right and left first locking portions 36, 37 formed in the holder 33 contact the connector housing 22 from below. In this way, the resilient deforming portions 35 are expanded and deformed in the lateral direction. Further, the second locking portion 40 provided in the holder 33 contacts the wire routing portion 24 from below and deforms resiliently rearward.

If the connector housing 22 having the cover 27 mounted thereon is pressed farther down, the left and right first locking portions 36, 37 ride over the connector housing 22 and the second locking portion 40 rides over the wire routing portion 24. In this way, the resilient deforming portions 35 and the arm 39 are restored. Then, the left and right first locking portions 36, 37 contact the connector housing 22 from above to prevent an upward escape of the connector housing 22 from the holder 33. Further, the second locking portion 40 contact the wire routing portion 24 from above to prevent an upward escape of the wire routing portion 24 from the holder 33.

Figure 18:
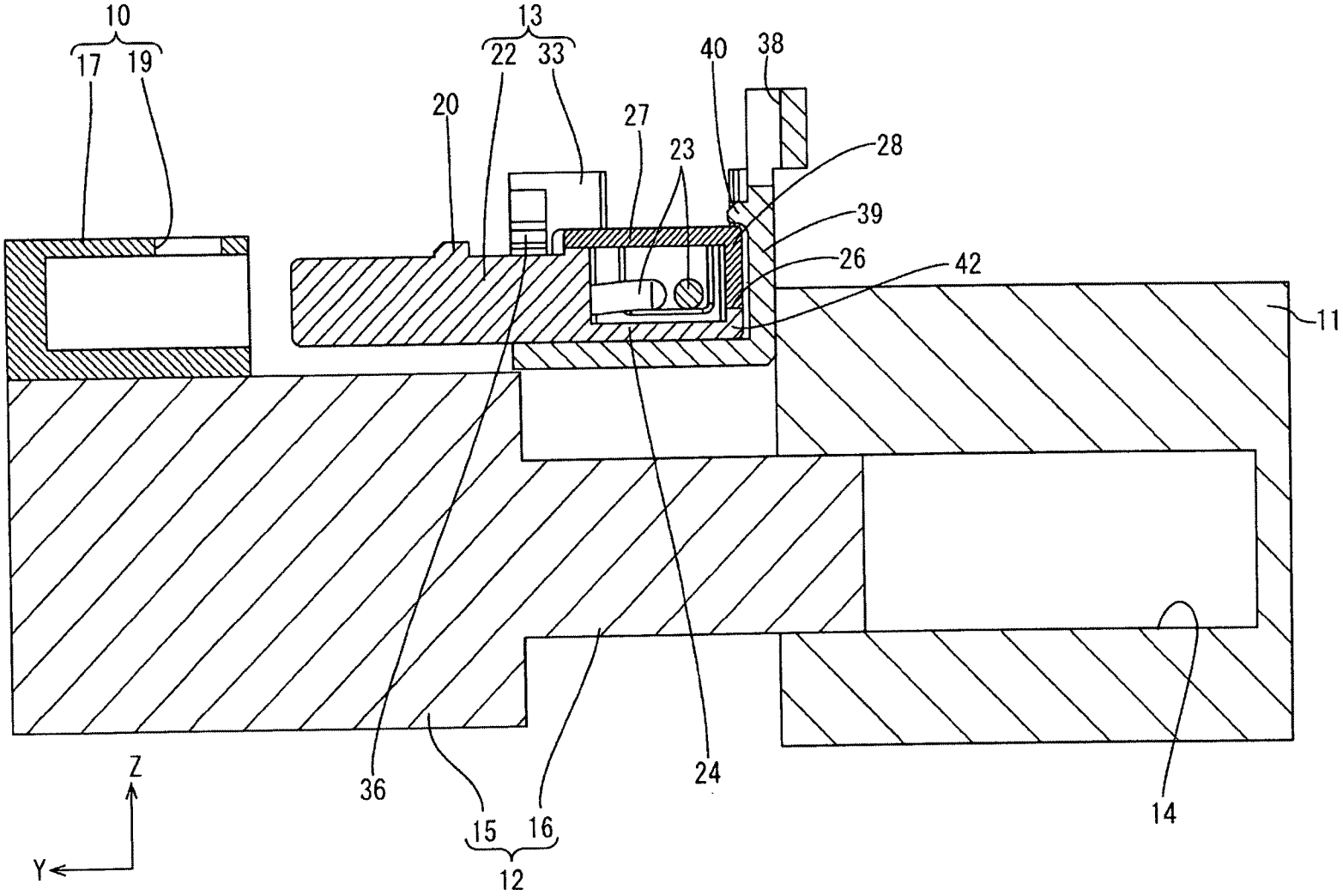
FIG. 18 is a section showing a connection process of the device-side connector and the standby connector.

As shown in FIG. 18, the solenoid mounting portion 14 of the valve body 11 faces forward and the small-diameter portion 16 of the solenoid 12 is located in front of the solenoid mounting portion 14. Then, the valve body 11 is moved forward, thereby accommodating the small-diameter portion 16 of the solenoid 12 into the solenoid mounting portion 14.

At this time, the standby connector 13 and the device-side connector 10 are connected. First, the entire standby connector 13 moves forward by a forward movement of the valve body 11.

Figure 19:
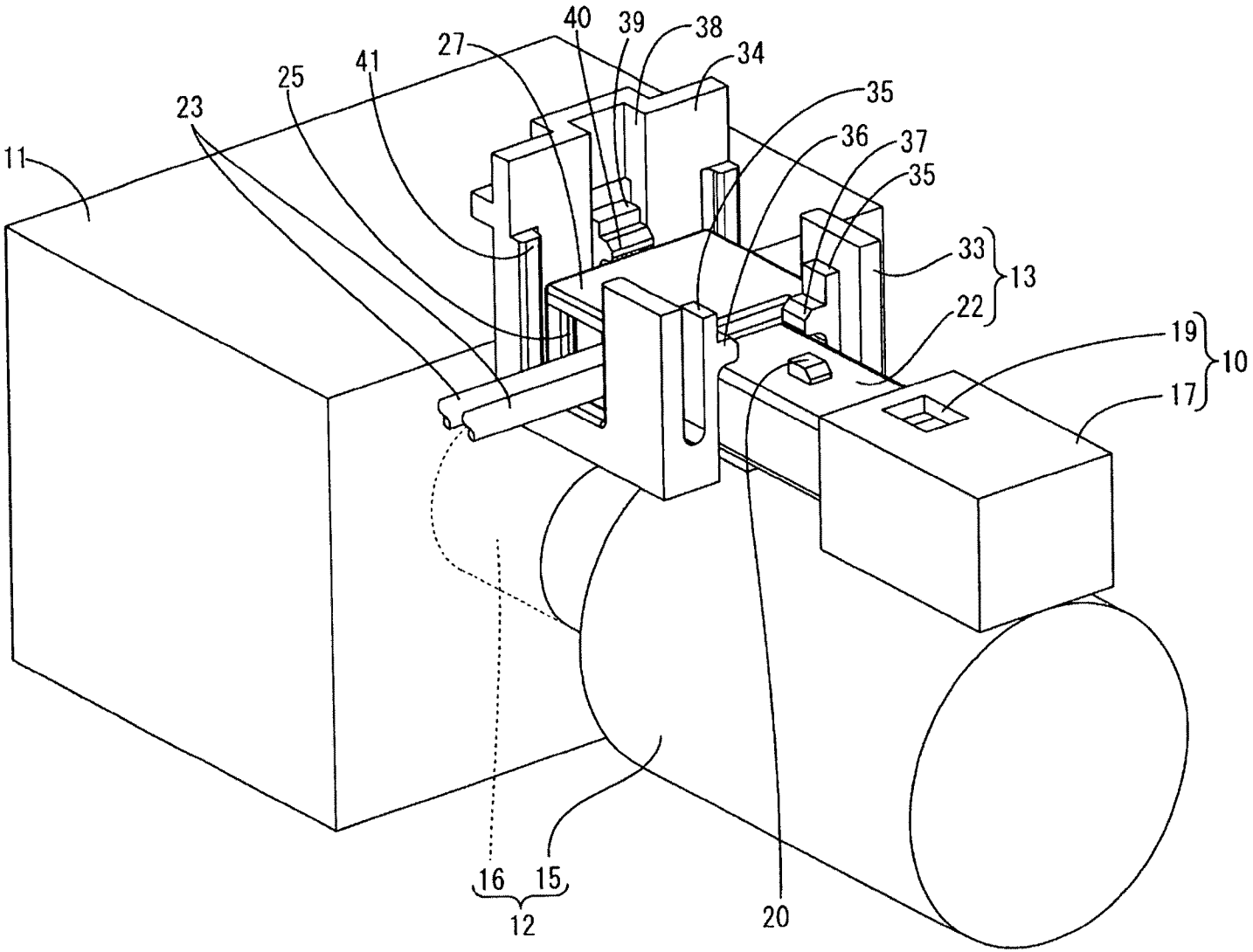
FIG. 19 is perspective view showing the connection process of the device-side connector and the standby connector.
Figure 20:
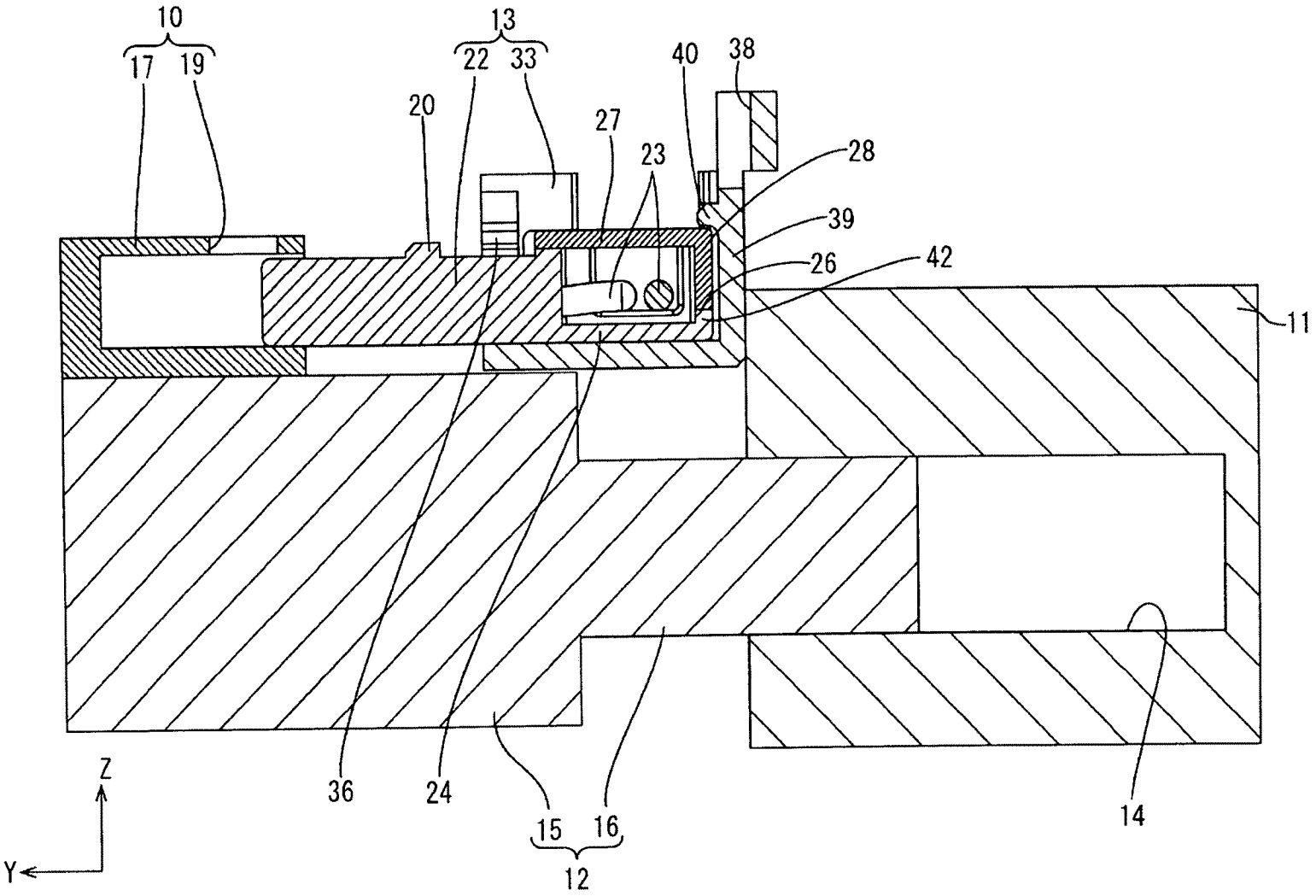
FIG. 20 is a section showing the connection process of the device-side connector and the standby connector.

If the valve body 11 is moved farther forward, the connector housing 22 moves forward and the front end of the connector housing 22 contact a rear part (opening end part) of the receptacle 17 of the device-side connector 10 from behind (see FIGS. 19 and 20). At this time, if the connector housing 22 and the receptacle 17 of the device-side connector 10 are deviated positionally in the lateral direction, either a leftward force or a rightward force is applied to the connector housing 22.

Then, the connector housing 22 contact one of the resilient deforming portions 35 disposed on both left and right sides of the connector housing 22. In this way, at least one of the resilient deforming portions 35 is resiliently deformed in a direction to be expanded with respect to the lateral direction. As a result, a positional deviation between the connector housing 22 and the receptacle 17 of the device-side connector 10 is absorbed by the resilient deforming portions 35.

Figure 21:
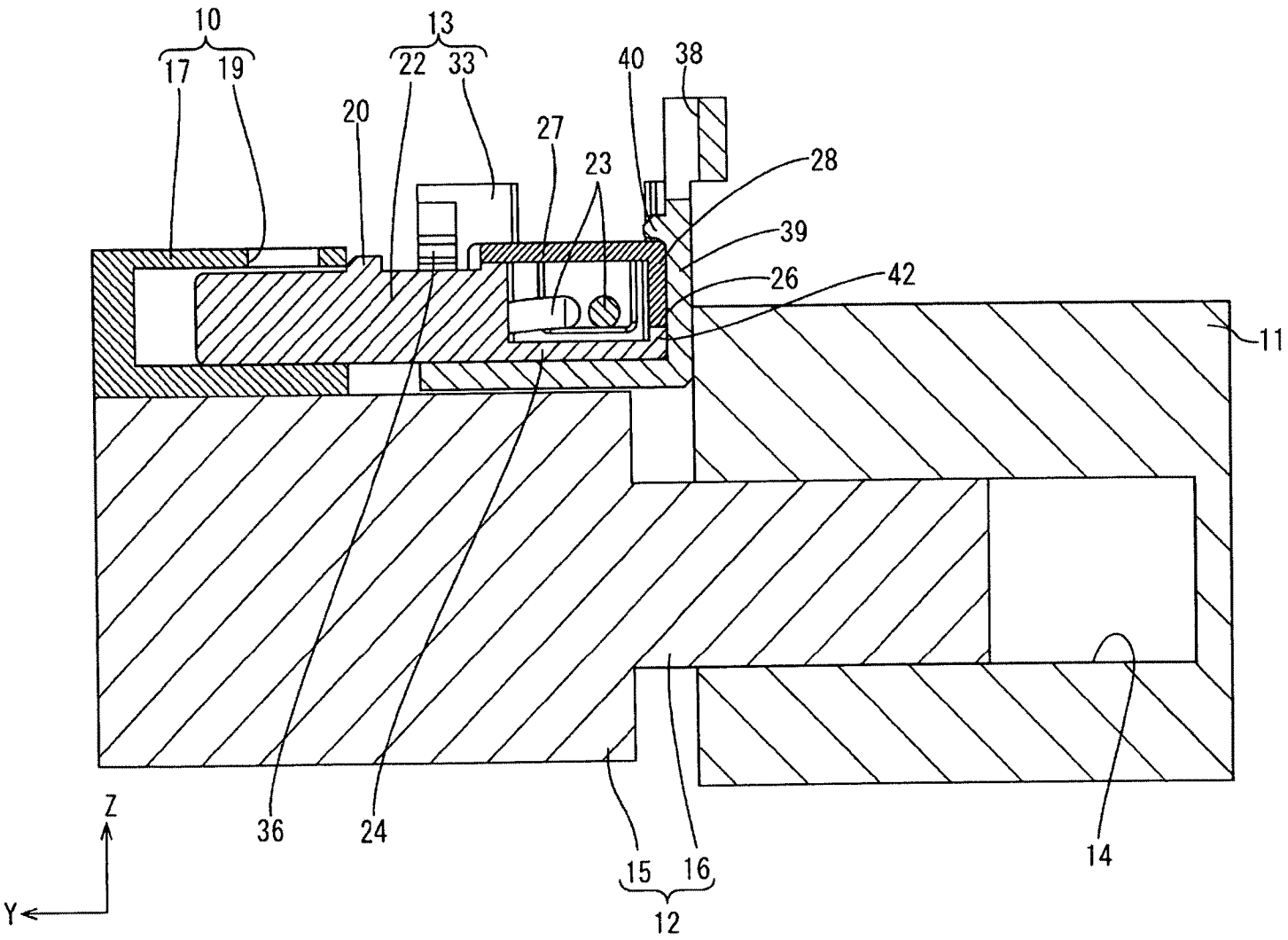
FIG. 21 is a section showing the connection process of the device-side connector and the standby connector.

If the valve body 11 is pressed farther forward with the positional deviation in the lateral direction between the connector housing 22 and the receptacle 17 of the device-side connector 10 eliminated, as described above, the connector housing 22 is accommodated into the receptacle 17 of the device-side connector 10. Then, as shown in FIG. 21, the lock protrusion 20 of the connector housing 22 contacts the rear part of the receptacle 17 from behind. Since a forward movement of the connector housing 22 is suppressed in this way, the rear wall 34 of the holder 33 mounted on the valve body 11 contacts the rear wall 42 of the wire routing portion 24 from behind. If the valve body 11 is pushed farther forward, the lock protrusion 20 of the connector housing 22 is locked into the lock hole 19 of the receptacle 17 and the connector housing 22 and the device-side connector 10 are held in a connected state (see FIG. 3).

(Functions and Effects of Embodiment)

Next, functions and effects of this embodiment are described. This embodiment relates to the standby connector 13 connectable to the device-side connector 10 mounted on the solenoid 12 and including the connector housing 22 connectable to the device-side connector 10 along the connecting direction and the holder 33 for holding the connector housing 22. The holder 33 includes the resilient deforming portions 35 located on both lateral sides of the connector housing 22 with respect to the intersecting direction that intersects the connecting direction and are resiliently deformable in the intersecting direction. At least one of the resilient deforming portions 35 contacts the connector housing 22 and resiliently deforms when a force in the intersecting direction is applied to the connector housing 22.

If there is a positional deviation between the standby connector 13 and the device-side connector 10 in the intersecting direction, the standby connector 13 and the device-side connector 10 contact, and the connector housing 22 receives a force in the intersecting direction. According to the above configuration, even if there is a positional deviation between the standby connector 13 and the device-side connector 10 in the intersecting direction, the resilient deforming portions 35 resiliently deform in the intersecting direction to absorb the positional deviation. Thus, the standby connector 13 and the device-side connector 10 can be connected smoothly.

According to this embodiment, the connector housing 22 is assembled with the holder 33 in the assembling direction intersecting the connecting direction and different from the intersecting direction. The resilient deforming portions 35 extend along the assembling direction and respectively include the left and right first locking portions 36, 37 to be locked to the connector housing 22 from behind in the assembling direction. Accordingly, the connector housing 22 can be assembled with the holder 33 along the assembling direction.

Further, the connector housing 22 includes the wire routing portion 24 at a rear position in the connecting direction, and the wires 23 drawn out from the connector housing 22 are disposed in the wire routing portion 24 in the direction intersecting the connecting direction. Additionally, the holder 33 includes the rear wall 34 for pressing the wire routing portion 24 forward from behind in the connecting direction. According to this configuration, the wires 23 are not disposed in an area behind the wire routing portion 24 in the connecting direction, and the holder 33 can be provided with the rear wall 34 for pressing the wire routing portion 24 forward from behind in the connecting direction. As a result, the connector housing 22 and the device-side connector 10 can be connected by pressing the connector housing 22 held in the holder 33 forward in the connecting direction by the rear wall 34.

Further, the resilient deforming portions 35 extend along the assembling direction and respectively include the left and right first locking portions 36, 37 to be locked to the connector housing 22 from behind in the connecting direction. Additionally, the pressing portion includes the second locking portion 40 to be locked to the wire routing portion 24 from behind in the assembling direction. Accordingly, the second locking portion 40 prevents the wire routing portion 24 from moving rearward in the assembling direction and separated from the holder 33.

The invention is not limited to the above described and illustrated embodiment. For example, the following embodiments also are included in the scope of the invention.

Although the resilient deforming portion 35 extends along the vertical direction (assembling direction) in the above embodiment, there is no limitation to this and the resilient deforming portion 35 may extend along the front-rear direction (connecting direction) and can have other shapes.

Although the standby connector 13 is applied to the hydraulic control device of the automatic transmission of the vehicle in the above embodiment, there is no limitation to this and the standby connector 13 can be applied to an other connector structures.

The wire routing portion 24 may be omitted.

The wires 23 may be drawn out rearward from the connector housing 22 or may be drawn out in any direction from the connector housing 22.

Although the rear wall 34 of the holder 33 serves as the pressing portion in the above embodiment, there is no limitation to this and the pressing portion may be provided on another member. Further, the pressing portion may be omitted.

The left and right first locking portions 36, 37 may be omitted. Further, the second locking portion 40 may be omitted.

One, three or more female terminals may be accommodated in the connector housing 22.

LIST OF REFERENCE SIGNS

10: device-side connector
12: solenoid
13: standby connector
22: connector housing
23: wire
24: wire routing portion
33: holder
34: rear wall
35: resilient deforming portion
36: left first locking portion
37: right first locking portion
40: second locking portion

The invention claimed is:

1. A standby connector connectable to a device-side connector mounted on a device, comprising:

a connector housing having opposite front and rear ends, the front end of the connector housing being connectable to the device-side connector along a connecting direction, a wire routing portion at the rear end of the connector housing and having a bottom wall extending rearward from the connector housing, a rear wall extending up from the bottom wall and an upwardly open recess extending down from an upper end of the rear wall, the wire routing portion guiding at least one wire from the connector housing in an intersecting direction intersecting the connecting direction; and a holder formed separately from the connector housing and holding the connector housing, the holder having opposite front and rear ends, a bottom wall extending between the front and rear ends of the holder and positioned adjacent the bottom wall of the wire routing portion, a rear wall projecting up from the bottom wall at the rear end of the holder, left and right resilient deforming portions at opposite left and right sides of the holder adjacent the front end of the holder and being resiliently deformable toward and away from one another, wherein:

the left and right resilient deforming portions contact opposite left and right sides of the connector housing forward of the wire routing portion to deform resiliently when a force toward the bottom wall of the holder is applied to the connector housing, and the rear wall of the holder presses the rear wall of the wire routing portion forward from behind in the connecting direction.

2. The standby connector of claim 1, wherein:

the holder has an open top opposite the bottom wall, and the connector housing is assembled with the holder in an assembling direction intersecting the connecting direction and different from the intersecting direction, the resilient deforming portions extend along the assembling direction, each of the resilient deforming portions includes a first locking portion to be locked to the connector housing from a side opposite the bottom wall of the holder.

3. The standby connector of claim 1, wherein:

the holder has an open top opposite the bottom wall, and the connector housing is assembled into the open top of the holder in an assembling direction intersecting the connecting direction and different from the intersecting direction, the resilient deforming portions extend along the assembling direction, each of the resilient deforming portions includes a first locking portion to be locked to the connector housing from a side opposite the bottom wall, and the holder includes a second locking portion to hold the wire routing portion against the bottom wall of the holder.

4. The standby connector of claim 1, wherein the wire routing portion has an open top opposite the bottom wall of the wire routing portion, and the standby connector further comprising a cover formed separately from the connector housing and covering the open top of the wire routing portion.

5. The standby connector of claim 4, wherein the cover includes a projection extending into the recess in the rear wall of the wire routing portion.

6. The standby connector of claim 4, wherein the holder includes a second locking portion projecting from the bottom wall of the holder at the rear end of the connector housing, the second locking portion engaging the cover to hold the wire routing portion against the bottom wall of the holder.

7. The standby connector of claim 4, wherein the wire routing portion has opposite left and right side walls, a window being formed in at least one of the left and right side walls of the wire routing portion for guiding the at least one wire from the connector housing in the intersecting direction.

8. The standby connector of claim 7, wherein the holder has opposite left and right side walls adjacent to and outwardly of the side walls of the wire routing portion, at least one of the left and right walls of the holder has a holder-side window at least partly aligned with the window in the wire routing portion for accommodating the at least one wire guided from the connector housing in the intersecting direction.

* * * * *